US007131866B2

(12) United States Patent
Zuch

(10) Patent No.: US 7,131,866 B2
(45) Date of Patent: Nov. 7, 2006

(54) COUPLING FOR COAXIAL CABLES

(75) Inventor: Gerhard Zuch, Fürth (DE)

(73) Assignee: Framatome ANP GmbH, Erlangen (DE)

( * ) Notice: Subject to any disclaimer, the term of this patent is extended or adjusted under 35 U.S.C. 154(b) by 0 days.

(21) Appl. No.: 11/068,266

(22) Filed: Feb. 28, 2005

(65) Prior Publication Data

US 2005/0260878 A1 Nov. 24, 2005

Related U.S. Application Data

(63) Continuation of application No. PCT/EP2003/009316, filed on Aug. 22, 2003.

(30) Foreign Application Priority Data

Aug. 29, 2002 (DE) ..... 102 40 563

(51) Int. Cl.
*H01R 9/05* (2006.01)

(52) U.S. Cl. ..... 439/578; 439/675; 439/700

(58) Field of Classification Search ..... 439/578, 439/700, 675

See application file for complete search history.

(56) References Cited

U.S. PATENT DOCUMENTS

| | | | | |
|---|---|---|---|---|
| 3,416,125 | A | 12/1968 | Theve | |
| 4,012,105 | A | 3/1977 | Biddle | |
| 4,229,061 | A | 10/1980 | Majors | |
| 5,021,001 | A | 6/1991 | Ramirez | |
| 5,827,079 | A | 10/1998 | Murata | |
| 6,053,777 | A | 4/2000 | Boyle | |
| 6,396,367 | B1 * | 5/2002 | Rosenberger | 333/260 |
| 6,398,592 | B1 * | 6/2002 | Mori et al. | 439/700 |
| 2002/0186025 | A1 | 12/2002 | Neven et al. | |

FOREIGN PATENT DOCUMENTS

| | | |
|---|---|---|
| DE | 2 301 798 | 7/1974 |
| DE | 199 58 584 C1 | 2/2001 |
| EP | 0 314 229 A1 | 5/1989 |
| EP | 1 102 359 A1 | 5/2001 |
| FR | 2 783 639 A1 | 3/2000 |

* cited by examiner

*Primary Examiner*—Truc Nguyen
(74) *Attorney, Agent, or Firm*—Laurence A. Greenberg; Werner H. Stemer; Ralph E. Locher

(57) ABSTRACT

A connector interconnect two coaxial cables each having a central conductor surrounded by an outer conductor. A respective connector piece is assigned to each coaxial cable. The invention ensures the easy and rapid use of the connector, while reliably guaranteeing the electrical contact between the interconnected coaxial cables. To achieve this, each connector piece has one connection region that is electrically connected to the respective central conductor of the corresponding coaxial cable, a connection head of the second connector piece being supported on the connection region of said piece by means of a spring element, in order to make electrical contact with the connection region of the first connector piece.

11 Claims, 4 Drawing Sheets

COUPLING FOR COAXIAL CABLES

CROSS-REFERENCE TO RELATED APPLICATION

This is a continuing application, under 35 U.S.C. § 120, of copending international application No. PCT/EP2003/009316, filed Aug. 22, 2003, which designated the United States; this application also claims the priority, under 35 U.S.C. § 119, of German patent application No. 102 40 563.8, filed Aug. 29, 2002; the prior applications are herewith incorporated by reference in their entirety.

BACKGROUND OF THE INVENTION

Field of the Invention

The invention relates to a coupling for coaxial cables. Each of the two coaxial cables to be coupled to one another has a central conductor, which is surrounded by an outer conductor. Each coaxial cable has a coupling piece associated therewith, each of which has a connecting area which is electrically connected to the central conductor of the coaxial cable associated with it. A connection head, which is provided in order to produce an electrical contact with the connecting area of the first coupling piece and is mounted on it such that it can move, of the second coupling piece is supported on its connecting area via a spring element.

A coupling such as this is disclosed, for example, in European published patent application EP 0 314 299 A1. Couplings for coaxial cables with spring-mounted connection elements are also disclosed in the prior U.S. Pat. Nos. 3,416,125, 4,012,105, and 6,053,777.

A coupling such as this may be important in many industrial applications wherein coaxial cables must be disconnected from one another and reconnected quickly and easily, for example for maintenance work. In particular, a coupling such as this may be used with rigid coaxial conductors, such as those used for the transmission of electrical signals or pulses in a nuclear installation or in a nuclear power station installation.

In nuclear power station installations, the filling level of an operating or cooling medium in a container which cannot be looked into directly must be monitored and, if required, readjusted, for example the filling level of the primary coolant in the reactor pressure vessel. The so-called TDR (time domain reflectometry) measurement principle may be used for this purpose, as is known, by way of example from German patent DE 199 58 584 C1 (corresponding to U.S. Patent Application Publication No. 2002/0186025). The TDR measurement principle makes use of the effect that an electromagnetic pulse which is carried in an antenna system is partially reflected when the impedance between, for example, a central conductor of the antenna and an outer conductor which surrounds it in the form of a coaxial cable changes abruptly.

An abrupt change in the impedance such as this occurs, for example, where the antenna that is formed in this way enters a liquid from a gaseous environment, since the impedance depends on the capacitance between the central conductor and the outer conductor, and thus on the dielectric constants of the medium filling the space between the central conductor and the outer conductor. An electromagnetic pulse which is passed to an antenna such as this that is immersed in the medium to be monitored is thus partially reflected on the surface of the medium. A further reflection occurs at the normally short-circuited antenna end. Since, apart from this, the propagation speed of the electromagnetic pulse in the antenna is known, the propagation time difference between the pulse reflected on the boundary layer and the pulse reflected at the antenna end can be used as a measure of the position of the boundary layer, and thus as a means for determination of a position value which is characteristic of the position of the boundary layer, wherein case it can be assumed that there is an essentially proportional relationship between the propagation time difference and the characteristic position value.

In order to make it possible to use this method for diagnosis and for monitoring of, for example, a medium in a closed container, it is thus necessary to transmit electromagnetic pulses from an external area into the interior of the container, and vice versa. On the other hand, however, depending on the nature and characteristics of the medium stored in the container, it may be absolutely essential or at least of major importance to ensure that the container is sealed particularly well. Depending on the operating parameters in the container by virtue of the design, such as the pressure and temperature of the medium stored there, the electrical bushing which is used to pass electromagnetic pulses in and out is thus subject to particularly stringent requirements in some specific cases. This also applies to the transmission of an electromagnetic pulse from the containment surrounding the reactor pressure vessel to a pulse generator and to an evaluation and control unit, and vice versa.

In this case, by way of example, rigid coaxial conductors may be used to transmit electromagnetic pulses between the containment wall and the reactor pressure vessel, in particular in order to ensure the high signal quality which is required to ensure that reliable measured values are obtained. Nevertheless, however, it may be necessary to make the reactor pressure vessel accessible, for example for maintenance work. In order to allow this with only little effort even using rigid coaxial conductors, a coupling apparatus is desirable which allows segments of the coaxial conductor to be disconnected from one another and to be reconnected quickly and without any complications between the two bushings that have been mentioned.

In order to keep the interference with and the attenuation of the electromagnetic pulse as low as possible even at the coupling point in a system such as this, the coupling should satisfy stringent requirements. In particular, the impedances should be kept constant over the length of the conductor, or at least should not change with any discontinuities, so that disturbing reflections at sudden impedance changes are avoided as well as possible for the measurement. A high-quality electrical contact between conductors that are connected by means of the coupling is particularly important for reliable transmission of the electromagnetic pulse.

SUMMARY OF THE INVENTION

It is accordingly an object of the invention to provide a coupling for coaxial cables which overcomes the above-mentioned disadvantages of the heretofore-known devices and methods of this general type and which provides for a coupling that, on the one hand, can be operated easily and quickly and, on the other hand, ensures the electrical contact between the coupled coaxial conductors with high reliability.

With the foregoing and other objects in view there is provided, in accordance with the invention, a coupling for connecting two coaxial cables to one another, each of the coaxial cables having a central conductor surrounded by an outer conductor.

The coupling comprises:

first and second coupling pieces each associated with a respective coaxial cable and each having a connecting area electrically connected to the central conductor of the respective coaxial cable;

a connection head movably mounted on the second coupling piece for producing electrical contact with the connecting area of the first coupling piece, and a spring element supporting the connection head on the connecting area of the second coupling piece;

the connection head ending in a number of contact fingers which are inserted into recesses formed in the connecting area of the second coupling piece, the connecting area of the second coupling piece being provided with a contact piece having an associated connecting surface for at least one of the contact fingers.

In other words, the objects of the invention are achieved in that the end of the connection head which faces the connecting area of the second coupling piece is provided with contact fingers which are inserted into recesses, that are provided for this purpose, in the connecting area of the second coupling piece, with the connecting area of the second coupling piece being provided with a contact piece which has an associated connecting surface for the or each contact finger.

The invention is in this case based on the concept that a coupling mechanism for coaxial cables should be easily operable, that is to say should allow the cables to be coupled and decoupled quickly and easily. At the same time, however, the electrical contact between coaxial conductors which are connected via the coupling should also be particularly intensive during operation of the installation. In order to satisfy these two fundamentally mutually contradictory conditions, the coupling is provided with an apparatus which reinforces the contact between the conductors to be coupled, to a particular extent. In this case, the deliberate use of the restoring force of a spring element is provided, with the spring being loaded while the two coaxial conductors are being coupled, and thus continuously exerting a force, which assists the electrical contact, on the two conductors.

In order to make it possible to ensure that there is a particularly close contact between the connection head and the connecting area of the first coupling piece, the connection head is in this case mounted on the connecting area of the first coupling piece such that it can move. In this case, the connection head is expediently positioned with the coupling open in such a way that, during mating of the coupling, the connecting area of the first coupling piece moves the connection head towards the connecting area of the second coupling piece, and thus loads the spring element. The spring element restoring force produced in this way in consequence leads to the connection head being permanently pressed against the first coupling piece, and thus to a particularly reliable electrical connection. The contact fingers result both in centering of the connection head with respect to the longitudinal axis of the coupling and in the production of the electrical contact between the connection head and the connecting area. The interaction of the contact fingers with the associated recesses and in particular with contact surfaces arranged in them ensure an adequate contact with the connecting area fitted to it at all times even when the connection head is moved in the longitudinal direction.

The contact fingers on the connection head surround a contact piece which is fitted to the connecting area of the second coupling piece and is used to ensure the electrical contact between the connection head and the connecting area. Depending on the load on the spring element associated with the connection head, the contact fingers rest on a larger or smaller area of the contact piece. The contact piece thus additionally has the task of reliably maintaining the electrical contact between the connection head and the connecting area of the second coupling piece even if the length of the spring varies.

The connection head is advantageously inserted into a recess which is formed in the connecting area of the first coupling piece in such a way that it in consequence centers itself with respect to the longitudinal axis of the coupling. In this case, the shape of the connection head may, in particular, be convex and may be inserted into a corresponding concave recess in the connecting area of the first coupling piece, with both the connection head and the recess being rotationally symmetrical about the longitudinal axis of the coupling. This ensures that the connection head can be attached to the second coupling piece particularly easily and that the center axes of both coupling pieces cannot move with respect to one another while being coupled, which can lead to undesirable interference with the electromagnetic pulse and, furthermore, can make it impossible to connect the outer conductors to one another.

For manufacturing reasons, a conical recess in the connecting area of the first coupling piece is particularly advantageous in this case, with a corresponding connection head in the form of a truncated cone.

In accordance with an added feature of the invention, a retaining screw is advantageously anchored on the connecting area of the second coupling piece, holds the connection head on the connecting area and prevents the connection head from being completely loosened when the coupling is open. The outer conductor of each coupling piece is expediently equipped with a mounting flange which allows the coupling pieces to be connected to one another. In this case a circumferential seal is advantageously fitted between the mounting flanges and allows the coupling to be closed such that it is sealed.

In accordance with an additional feature of the invention, the two coupling pieces are expediently securely connected via a closure element which allows the two coupling pieces to be held together firmly. The shape and contours of a closure element such as this are matched to those of the mounting flanges, and it surrounds the mounting flanges in the mated state.

In an advantageous embodiment of the invention, the closure element is a clamping ring with a spring clip. This allows the coupling to be operated particularly easily and quickly.

Undesirable attenuation of the electromagnetic pulse can be precluded, or at least kept to a minor level, since the impedances do not change, or change only slightly, over the length of the coupling point. The appropriate components, that is to say in particular the connecting areas and the outer conductors surrounding them, are advantageously suitably designed to ensure this.

The advantages which are achieved by the invention are, in particular, that the use of a spring element for production of an electrical connection between the central conductors of the coaxial cables results in a coupling which can be operated particularly easily and quickly and ensures a particularly high-quality electrical connection between the coaxial conductors. This allows the coupling to be used even for sensitive measurements which require a high signal quality. The coupling is thus particularly suitable for use with coaxial conductors which transmit signals for TDR measurements in nuclear power stations.

Other features which are considered as characteristic for the invention are set forth in the appended claims.

Although the invention is illustrated and described herein as embodied in a coupling for coaxial cables, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
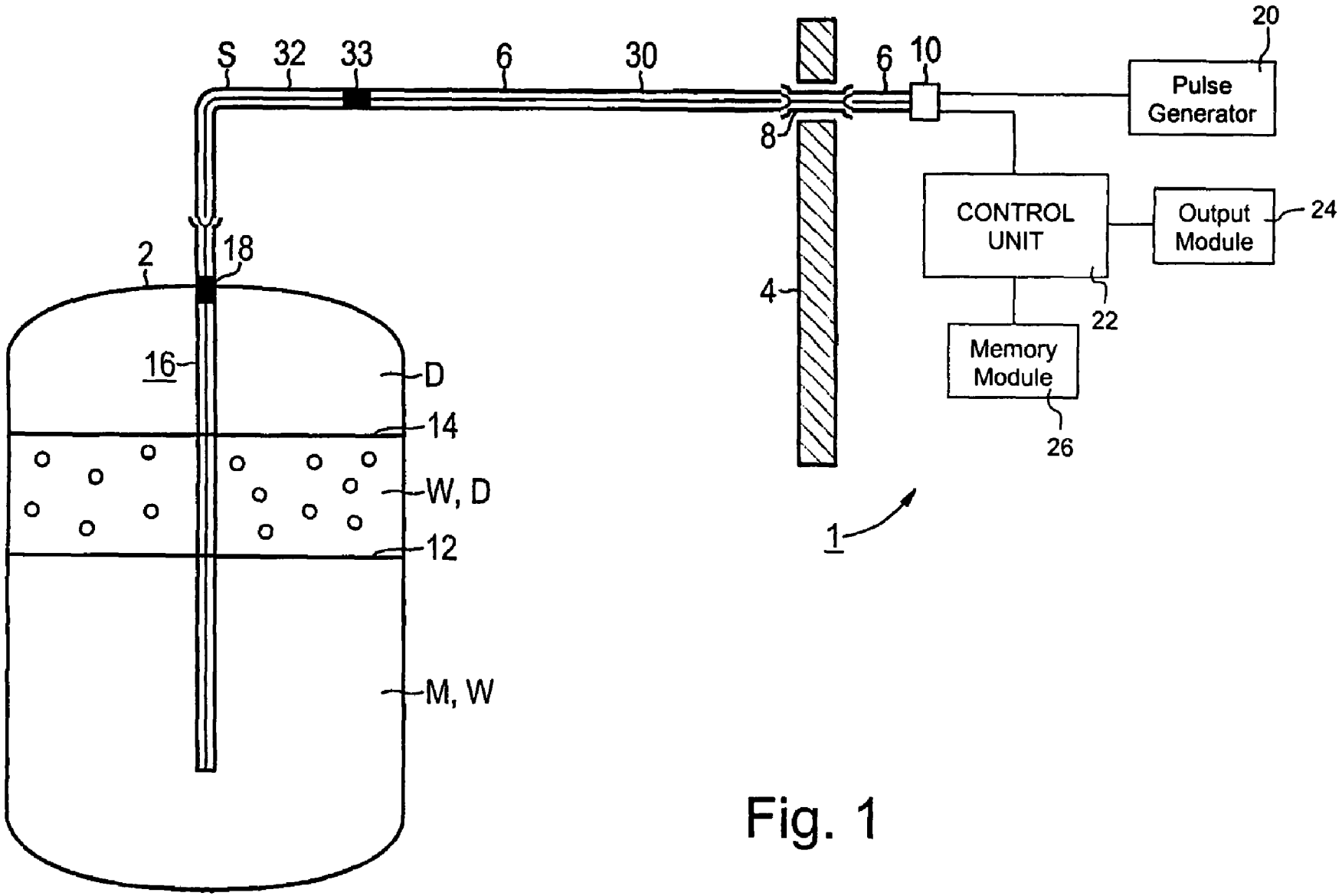
FIG. 1 is a schematic view of a system for monitoring the filling level in a closed reactor pressure vessel.

Referring now to the figures of the drawing in detail and first, particularly, to FIG. 1 thereof, there is shown a system 1 for monitoring a medium M within the connected reactor pressure vessel 2 of a nuclear installation. The reactor pressure vessel 2 is disposed within closed containment 4, an wall of which is indicated schematically in the figure. In order to transfer signals S in a suitable form, the reactor pressure vessel 2 is connected to a communication interface 10 for the system 1 via a signal line 6 which is passed via a bushing 8 through the containment 4.

Water W is stored as the medium M in the reactor pressure vessel 2 in the exemplary embodiment and is used as the primary coolant for the nuclear installation. The water W is in the so-called undercooled state in a lower area. In contrast, there is a phase mixture W,D between the water W and the vapor bubbles D which are formed in an area above this, wherein the nuclear fuel elements which are arranged in the reactor pressure vessel 2 are heated. In contrast, an area even farther above this contains exclusively vaporized primary coolant, that is to say exclusively steam D. The medium M which is stored in the container 2 thus has a first boundary layer 12 between water W and the phase mixture W,D, and a second boundary layer 14 between the phase mixture W,D and the steam D.

A large number of operating parameters must be monitored during the operation of the nuclear installation. In this case, inter alia, it may be desirable or necessary to monitor the position of the boundary layers 12, 14. For example, in this case, a filling level measurement can be used for the position of the boundary layer 14.

The system 1 is intended for real-time determination and the monitoring of position characteristic values for the boundary layers 12, 14. For this purpose, the system 1 is designed to use the so-called TDR measurement principle (time domain reflectometry). A substantially vertically arranged coaxial cable 16, which is used as an antenna, is provided within the reactor pressure vessel 2 for a TDR measurement such as this. The coaxial cable 16 is passed out of the reactor pressure vessel via an electrical bushing 18, and is connected to the signal line 6. The communication interface 10, which is connected to the signal line 6, is itself connected to a pulse generator 20, which produces the electromagnetic pulses, and to an evaluation and control unit 22 with an output module 24 and a memory module 26. The evaluation and control unit 22 is, of course, also connected to other components that are required for correct operation, such as an input apparatus.

The system 1 together with its components is specifically designed for use of the TDR measurement principle. Inter alia, particularly high-quality signal transport is desirable for this purpose in the lines provided for this purpose, in particular such as the signal line 6. In order to particularly assist this, the signal line 6 is itself in the form of a rigid coaxial cable.

However, in order to allow maintenance work to be carried out on the reactor pressure vessel 2, it may be necessary to break down the signal line 6 into individual pieces as required, to join them together again and, for example, decouple them from one another at various points between the bushing 8 and the bushing 18, and to recouple them together quickly and easily once the maintenance work has been carried out. For this purpose, the signal line 6 is composed of two or more coaxial cables 30, 32, which are detachably connected to one another via a coupling 33.

In order to comply with the transmission quality requirements, which are stringent overall, the coupling 33 is also specifically configured for this object. In this case, provision is made in particular for the coupling 33 to produce a particularly close electrical contact between the central conductors 34 and 35 in the coaxial cables 30, 32 to be connected, while being simple to operate overall.

Figure 2:
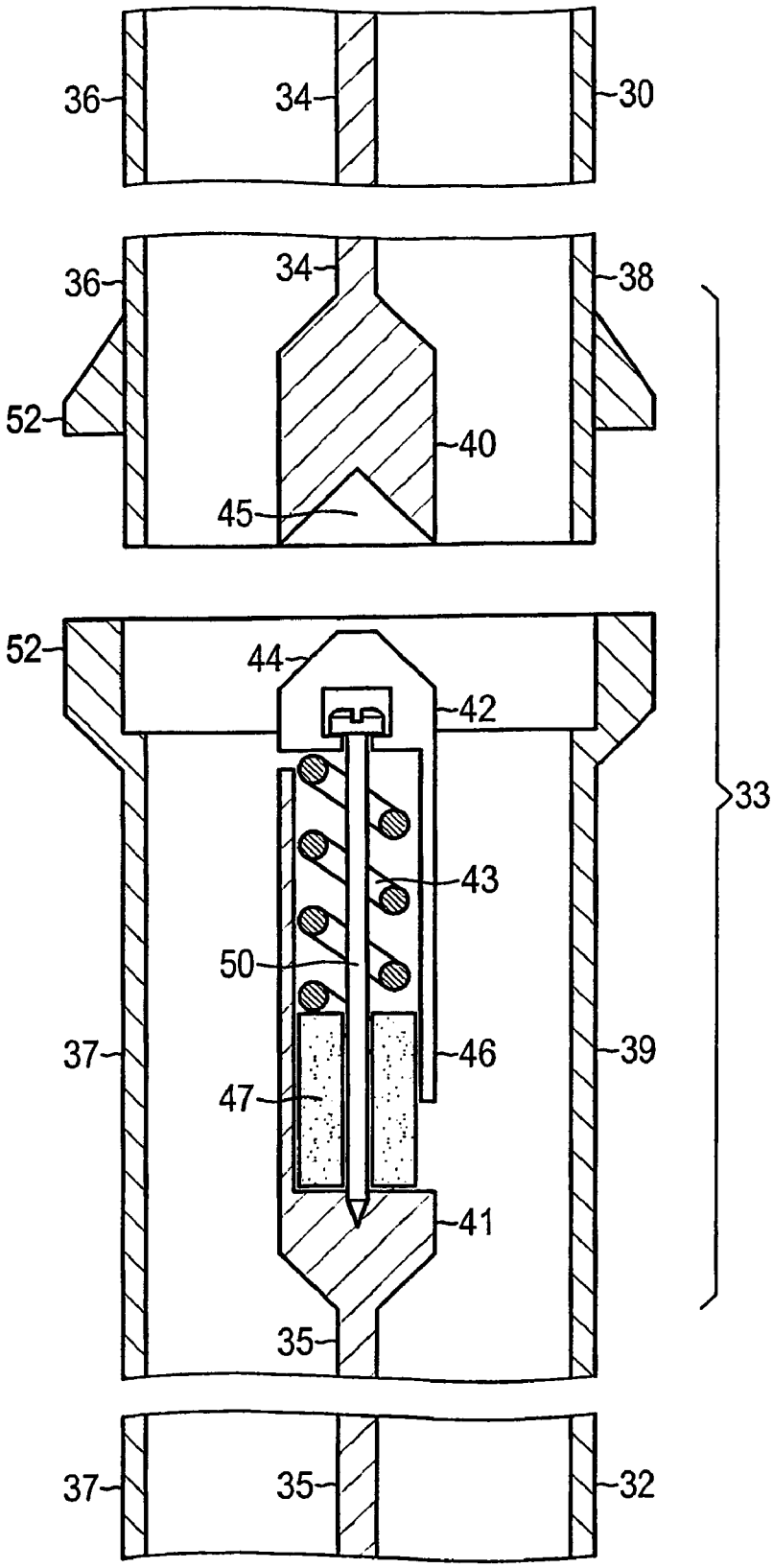
FIG. 2 is a cross section taken through a coupling for coaxial cables according to the invention.

As is illustrated in FIG. 2, the coaxial cable 30 and the coaxial cable 32 have a respective outer conductor 36 or 37 and a respective central conductor 34 or 35. The coupling 33 which is provided in order to connect the coaxial cables 30, 32 to one another accordingly comprises a first coupling piece 38 and a second coupling piece 39, with the coaxial cable 30 being firmly connected to the first coupling piece 38, and the coaxial cable 32 being firmly connected to the second coupling piece 39. The first coupling piece 38 has a connecting area 40 which is connected to the central conductor 34. The second coupling piece 39 likewise has a connecting area 41, which is connected in a corresponding manner to the central conductor 35 of the second coupling piece 39. In order to produce a particularly close contact, the connecting area 41 is equipped with the connection head 42 which can be brought into contact with the connecting area 40 and is supported in a sprung manner on the actual connecting area 41 via a spring element 43. The spring of the spring element 43 is loaded while the coupling 33 is being closed, and its resetting force presses the connection head 42 continuously against a corresponding contact surface of the connecting area 40 in the first coupling piece 38, thus ensuring a particularly reliable electrical connection. Suitable springs are, for example, spiral springs, plate springs, leaf springs or helical springs, as in the exemplary embodiment.

In order to allow the connection head 42 and the connecting area 40 to be joined together particularly easily and to allow the connection head 42 to be self-centering, the connection head 42 is equipped with, for example, a convex tip 44 which in the exemplary embodiment is in the form of a truncated cone and is inserted into, for example, a concave recess 45 which is provided for this purpose in the connecting area 40. The recess 45 in the exemplary embodiment is conical, and its contours are thus matched to the tip 44 of the connection head 42. The connection head 42 ends in a number of contact fingers 46 which are inserted into recesses 48 formed in the connecting area 41 of the second coupling piece 39. The contact fingers 46 which are fitted to the connection head 42 allow a high-quality electrical contact to be made between the connection head 42, and the connecting area 41, which supports it, in the second coupling piece 39. These contact fingers 46 surround a contact piece 47 which is fitted to the connecting area 41 and, depending on the load on the spring element 43, rest on a larger or smaller area of the contact piece 47. The contact fingers 46 can slide along the contact piece 47, with the electrical contact between the connection head 42 and the connecting area 41 of the second coupling piece 39 being ensured in every position of the contact fingers 46 by a connecting surface 49 of the contact piece 47. This ensures that there is a high-quality electrical contact between the connection head 42 and the connecting area 41 even if the spring has a variable length. The connection head 42 is held on the connecting area 41 by means of a retaining screw 50. This reliably prevents the connection head 42 from being completely loosened even when the coupling 33 is open.

The outer conductors 36 and 37 which surround the respective connecting areas 40 and 41 of the respective coupling pieces 38 and 39 are each provided with a mounting flange 52 which allows the coupling pieces 38 and 39 to be connected to one another.

Figure 3:
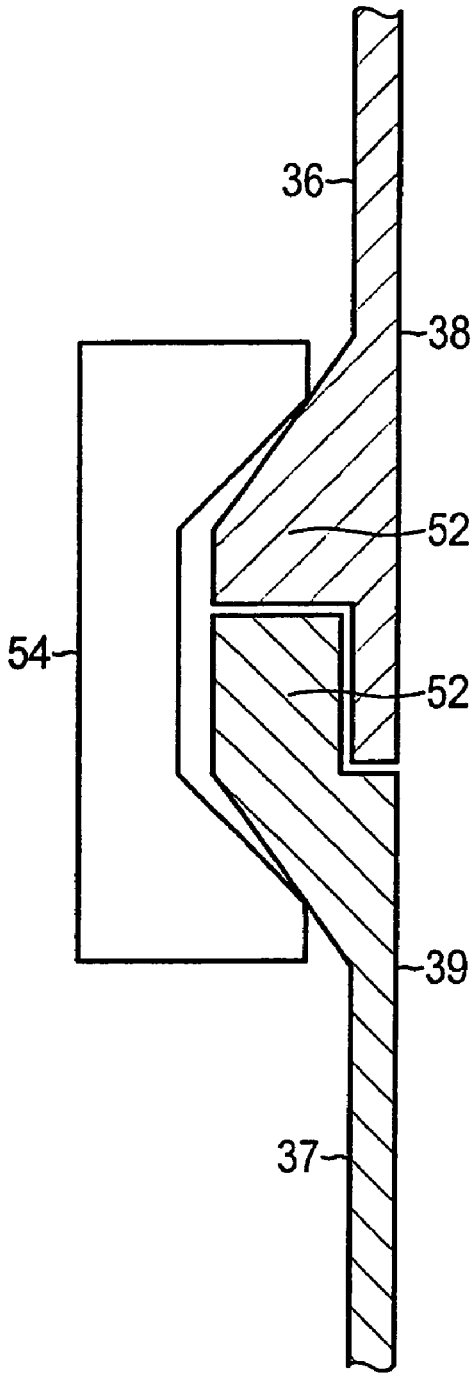
FIG. 3 is a cross section through the outer conductors of the coaxial cables with a closure element.
Figure 4:
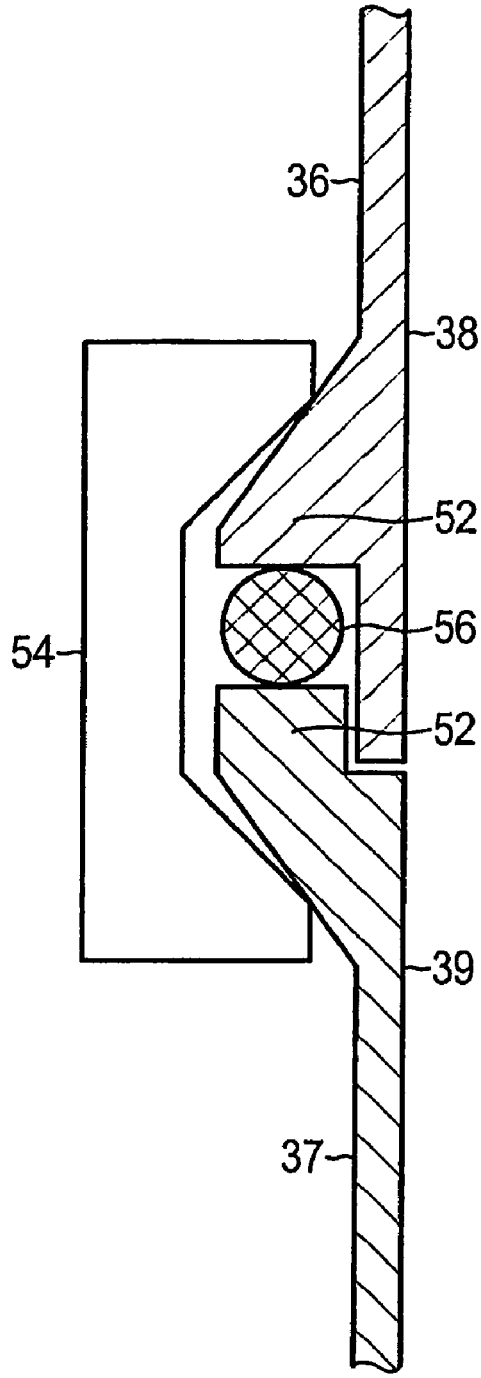
FIG. 4 is a cross section through the same outer conductors of the coaxial cables with a closure element and a seal.
Figure 5:
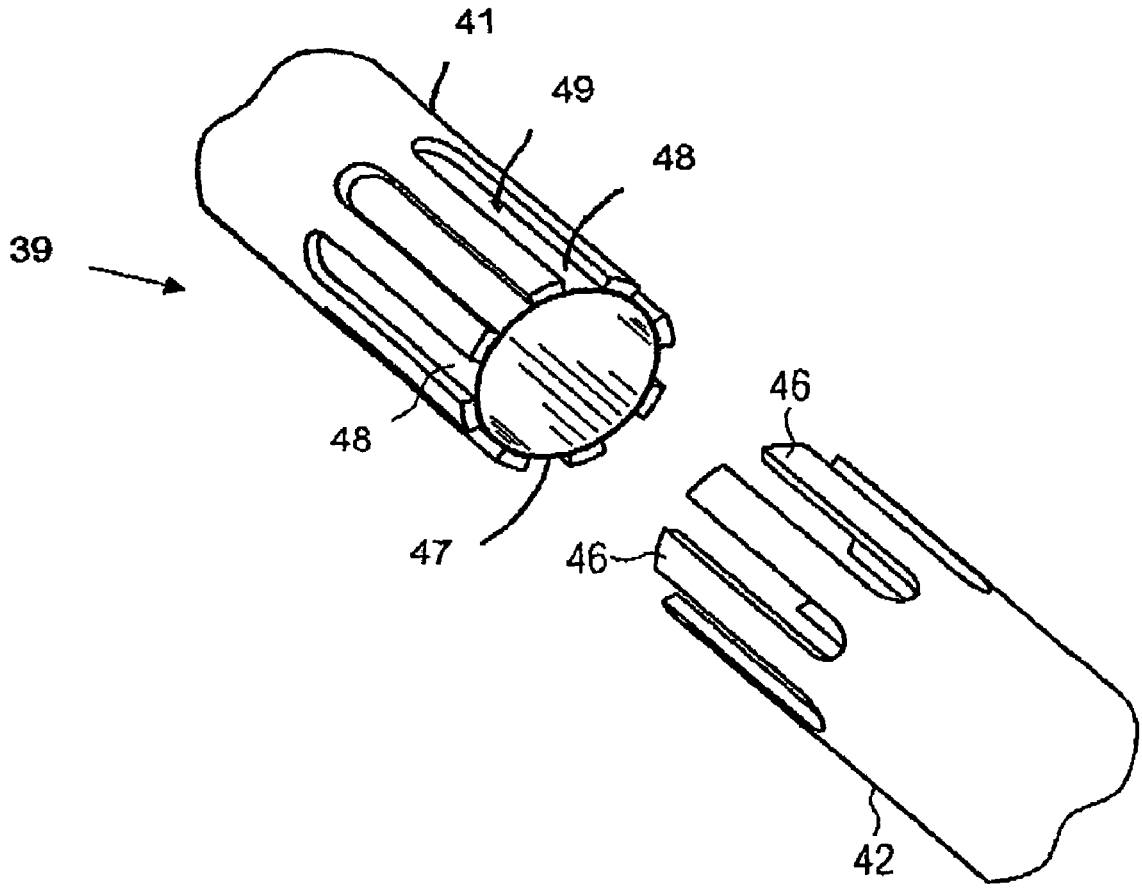
FIG. 5 is a perspective view of the connection area of the inner conductors showing the connecting fingers.

FIG. 3 shows a cross section through the outer conductors 36 and 37, respectively, of the coupling pieces 38 and 39 with a closure element 54 (for example a clamping ring which is held together by a non-illustrated spring clip) which surrounds the flanges 52 and thus connects the coupling pieces 38 and 39 to one another.

F*ig*. 4 likewise shows a cross section through the outer conductors 35 and 36 of the coupling pieces 38 and 39 with a closure element 54 which surrounds the mounting flanges 52, and thus connects the coupling pieces 39 and 39, and which is equipped with a circumferential seal 56. The seal 56 allows the closure element 54 to close the coupling 33 in a particularly sealed and secure manner.

I claim:

1. A coupling for connecting two coaxial cables to one another, each of the coaxial cables having a central conductor surrounded by an outer conductor, the coupling comprising:

first and second coupling pieces each associated with a respective coaxial cable and each having a connecting area electrically connected to the central conductor of the respective coaxial cable;

a connection head movably mounted on said second coupling piece for producing electrical contact with said connecting area of said first coupling piece, and a spring element supporting said connection head on said connecting area of said second coupling piece;

said connection head ending in a number of contact fingers which are inserted into recesses formed in said connecting area of said second coupling piece, said connecting area of said second coupling piece being provided with a contact piece having an associated connecting surface for at least one of said contact fingers.

2. The coupling according to claim 1, wherein said contact piece is formed with a connecting surface for each of said contact fingers.

3. The coupling according to claim 1, wherein said connection head and said connecting area of said first coupling piece are formed with contact surfaces having matching shapes such that said connection head is self-centered about said connecting area of said first coupling piece relative to a longitudinal axis of the coupling when the coaxial cables are coupled to one another.

4. The coupling according to claim 1, wherein said connection head is formed with a tip having a truncated cone shape and corresponding with a conical recess formed in said connecting area of said first coupling piece.

5. The coupling according to claim 1, which further comprises a retaining screw holding said connection head on said connecting area of said second coupling piece.

6. The coupling according to claim 1, which further comprises a mounting flange for the outer conductor surrounding the respective said connecting area of each of said first coupling piece and said second coupling piece.

7. The coupling according to claim 6, which further comprises a circumferential seal disposed between said mounting flanges.

8. The coupling according to claim 6, which further comprises a common closure element surrounding said mounting flanges in a mated state thereof.

9. The coupling according to claim 8, which further comprises a circumferential seal introduced between said mounting flanges.

10. The coupling according to claim 8, wherein said mounting flanges are surrounded by a common closure element in a mated state thereof.

11. The coupling according to claim 10, wherein said common closure element comprises a clamping ring and a spring clip.

* * * * *